US007102109B2

(12) United States Patent
Niiyama et al.

(10) Patent No.: US 7,102,109 B2
(45) Date of Patent: Sep. 5, 2006

(54) INDUCTION COOKING HEATER

(75) Inventors: Koji Niiyama, Kobe (JP); Naoaki Ishimaru, Mino (JP); Masayo Haji, Kawanishi (JP); Hirofumi Inui, Osaka (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 0 days.

(21) Appl. No.: 10/536,064

(22) PCT Filed: Oct. 28, 2004

(86) PCT No.: PCT/JP2004/016358

§ 371 (c)(1),
(2), (4) Date: May 24, 2005

(87) PCT Pub. No.: WO2005/072012

PCT Pub. Date: Aug. 4, 2005

(65) Prior Publication Data

US 2006/0081607 A1 Apr. 20, 2006

(30) Foreign Application Priority Data

Jan. 27, 2004 (JP) ..... 2004-017887

(51) Int. Cl.
*H05B 6/06* (2006.01)
*H05B 6/12* (2006.01)
*F24C 7/02* (2006.01)

(52) U.S. Cl. ..... 219/627; 219/626; 219/667; 219/494; 99/325

(58) Field of Classification Search ..... 219/620–627, 219/667, 711, 494; 99/325, 451; 374/142, 374/149
See application file for complete search history.

(56) References Cited

U.S. PATENT DOCUMENTS 3,781,504 A * 12/1973 Harnden, Jr. ..... 219/622

FOREIGN PATENT DOCUMENTS

JP 3-208288 9/1991

(Continued)

OTHER PUBLICATIONS

International Search Report corresponding to application No. PCT/JP2004/016358 dated Jan. 25, 2005.

(Continued)

*Primary Examiner*—Philip H. Leung
(74) *Attorney, Agent, or Firm*—RatnerPrestia

(57) ABSTRACT

An induction heating cooker includes a surface, a heating coil for inductionally-heating a load pan, an inverter for supplying a high-frequency current to the heating coil, an infrared detector which detects infrared radiation emitted from the load pan and is located under a top plate, a first temperature detector for detecting a temperature of the load pan based on an output of the infrared detector, a heating controller for controlling a power output from the inverter, a thermo-sensitive element for receiving heat from the top plate, and a second temperature detector for detecting a temperature of the load pan based on an output of the first thermo-sensitive element. This induction heating cooker detects a temperature change of the load pan accurately by detecting an infrared radiation from the load pan, and detects the temperature of the load pan by the heat conduction from the pan even if ambient light enters.

14 Claims, 9 Drawing Sheets

FOREIGN PATENT DOCUMENTS

| | | | | |
|---|---|---|---|---|
| JP | 5-174960 | * | 7/1993 | ..... 219/627 |
| JP | 2002-299029 | | 10/2002 | |
| JP | 2003-249341 | | 9/2003 | |
| JP | 2003-317918 | | 11/2003 | |
| JP | 2003-317919 | | 11/2003 | |
| JP | 2004-111055 | | 4/2004 | |
| JP | 2004-139894 | | 5/2004 | |
| JP | 2004-273302 | | 9/2004 | |

OTHER PUBLICATIONS

Form PCT/ISA/210.

* cited by examiner

INDUCTION COOKING HEATER

THIS APPLICATION IS A U.S. NATIONAL PHASE APPLICATION OF PCT INTERNATIONAL APPLICATION PCT/JP2004/016358.

1. Technical Field

The present invention relates to an induction heating cooker for heating a load pan with its output controlled based on the temperature of the load pan.

2. Background Art

In a conventional induction heating cooker disclosed in Japanese Patent Laid-Open Publication No. 2003-317919 for heating a load pan, a thermistor contacting a bottom surface of a top plate on which the load pan placed measures the temperature of the load pan.

In another conventional induction heater disclosed in Japanese Patent Laid-Open Publication No. 2003-317918 for heating a load pan, an infrared sensor mounted detects infrared radiation emitted from the load pan through an infrared-transmitting portion provided in a top plate, and measures the temperature of the load pan without contacting.

The top plate used in induction heating cooker is generally made of ceramic and has a low thermal conductivity. Therefore, in the former case that a thermo-sensitive element, such as a thermistor, receives heat by heat conduction, a delay of a thermal response of the top place causes a large temperature difference between the temperature detected by the thermO-sensitive element and an actual temperature of the load pan, thus preventing the temperature of the load pan from being detected precisely and quickly. In the latter case of the infrared sensor, the sensor detects temperature changes of the load pan quickly. However, in the case that the top plate is made of light-transmittable material, even when the infrared sensor is located just under the top place and the load pan, infrared radiation may be input from a surface of the top plate around a bottom of the load pan and be received as ambient light by the infrared sensor, thus preventing the sensor from measuring the temperature changes of the load pan accurately.

SUMMARY OF THE INVENTION

An induction heating cooker includes a top plate having an upper arranged to have a load pan placed over the upper surface and transmitting infrared radiation, a heating coil for inductionally-heating the load pan, an inverter for supplying a high-frequency current to the heating coil, an infrared detector which detects infrared radiation emitted from the load pan and is located under the second surface of the top plate, a first temperature detector for detecting a temperature of the load pan based on an output of the infrared detector, a heating controller for controlling a power output from the inverter, a thermo-sensitive element for receiving heat from the top plate, and a second temperature detector for detecting a temperature of the load pan based on an output of the first thermo-sensitive element. The heating controller determines that the temperature of the load pan becomes stable if a condition that a change of the temperature detected by the first temperature detector is within a predetermined range for a predetermined period of time is satisfied. When the temperature detected by the first temperature detector does not satisfy the condition, the heating controller determines that the temperature of the load pan becomes stable based on the temperature detected by the second temperature detector.

This induction heating cooker detects a temperature change of the load pan accurately by detecting an infrared radiation from the load pan, and detects the temperature of the load pan by the heat conduction from the pan even if ambient light enters, thereby preventing unintended heating from continuing.

DETAILED DESCRIPTION OF PREFERRED EMBODIMENTS

Exemplary Embodiment 1

Figure 1:
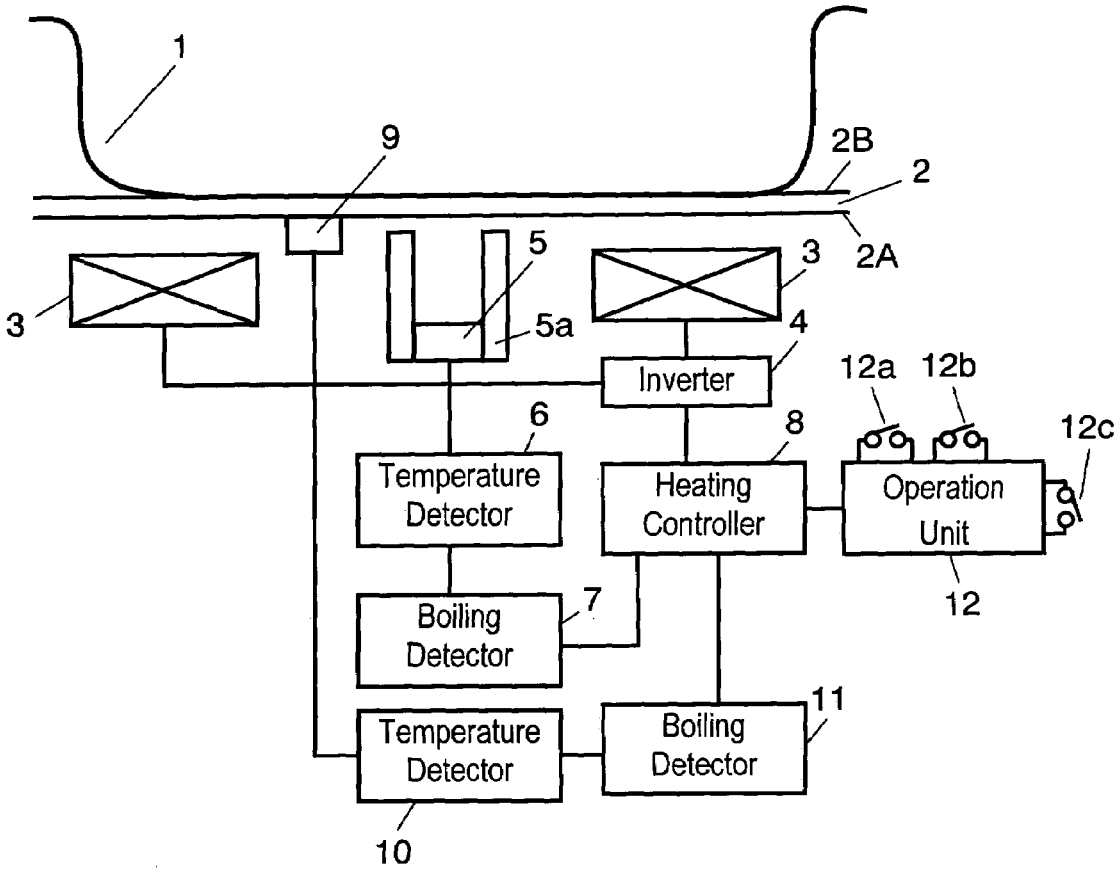
FIG. 1 is a block diagram of an induction heating cooker according to Exemplary Embodiment 1 of the present invention.

FIG. 1 is a block diagram of an induction heating cooker according to Exemplary Embodiment 1 of the present invention. Pan 1, a load pan accommodating water therein, is placed on top surface 2B, a first surface, of top plate 2 made of ceramic that is transparent and infrared-transmittable. Heating coil 3 accommodated in a case under bottom surface 2A, a second surface, of top plate 2 inductionally-heats pan 1. Heating coil 3 is a single annular heating coil having an opening in its center. In FIG. 1, heating coil 3 is shown as two separate parts and a cross section of its wound wired portion is shown schematically. Inverter 4 supplies a high-frequency current to heating coil 3. Infrared detector 5 detects the amount of infrared radiation having a predetermined frequency range and outputs a current corresponding to the amount. Infrared detector 5 is located at the center of heating coil 3 and under heating coil 3, and is surrounded by reflective cylinder 5*a* having an opening top. Temperature detector 6 detects a temperature change of a bottom surface of pan 1 based on a change of the current output from infrared detector 5. Boiling detector 7 detects, based on an output of temperature detector 6, that the temperature of pan 1 become stabile, that is, the water in pan 1 boils. Thermistor 9, a thermo-sensor, contacts bottom surface 2A of top plate 2 so as to receive heat from top plate 2 by heat conduction, thereby detecting the temperature of bottom surface 2A of top plate 2. Temperature detector 10 connected to thermistor 9 detects the temperature of bottom surface 2A of top plate 2 based on the resistance of thermistor 9. Boiling detector 11 detects the boiling of the water in pan 1 based on an output of temperature detector 10. Heating controller 8 controls a heating output of inverter 4 based on outputs of boiling detectors 7 and 11.

Heating controller 8 receives an output signal of operation unit 12 including switches 12*a*, 12*b*, and 12*c* activated by a user to input instructions. Switch 12*a* is a heating on/off key to start and stop a heating operation. Switch 12*b* is a water boiling key for the user to input a "water boiling instruction" to start an automatic water boiling sequence. In this sequence, heating starts with a predetermined output, the user is informed of the boiling of the water in pan 1 through an indicator (not shown) upon the boiling being detected, the heating output of inverter 4 is reduced for a predetermined period of time so as to keep pan 1 warm, and, after a lapse of the predetermined period of time, the heating stops. Switch 12*c* is an automatic rice cooking key for the user to input a "rice cooking instruction" to start an automatic rice cooking sequence. In this sequence, heating starts with a predetermined output, the user is informed of the completion of a rice cooking operation of water and rice in pan 1 upon the completion being detected, and the heating output is reduced so as to keep pan 1 warm.

An operation of the induction heating cooker of Embodiment 1 will be described below. A user puts pan 1 storing water therein on top surface 2B of top plate 2. Upon a switch (not shown) being turned on, a power is supplied to inverter 4 and heating controller 8. Upon the water boiling instruction being input through switch 12*b*, inverter 4 supplies a high-frequency current to heating coil 3 under a control by heating controller 8. The high-frequency current supplied to heating coil 3 generates a high-frequency magnetic field from the coil, thereby inductionally-heating the bottom of pan 1 on top plate 2 by eddy currents induced at the pan bottom. Then, the temperature of pan 1 accordingly rises, and the water receives the heat of pan 1 transmitted thereto, thereby boiling.

An operation of infrared detector 5 will be described below. According to the rising of the temperature of the bottom of pan 1, an infrared radiation corresponding to the temperature is emitted from the bottom of pan 1. Top plate 2 is made of light-transmittable ceramic material, such as glass ceramic, efficiently transmits an infrared radiation having a wavelength not longer than 2.5 μm. Therefore, infrared detector 5 may be implemented by a photo detector, such as a photo-diode capable of detecting light having a wavelength not longer than 2.5 μm, thereby receiving the infrared radiation having the wavelength efficiently through top place 2. Infrared detector 5 is surrounded by reflective cylinder 5*a* having an inner surface of a high-reflective mirror surface, and receives infrared radiation selectively from a predetermined position of pan 1 (e.g. from right above the opening at the center of heating coil 3). Reflective cylinder 5*a* intercepts the magnetic field from heating coil 3, thereby allowing the detector to accurately measure the amount of the infrared radiation emitted from the bottom of pan 1 and to detect the change of the measured infrared radiation. This allows a temperature change of the bottom surface of pan 1 to be measured accurately.

Temperature detector 6 converts a current generated by the photo-diode providing infrared detector 5 according to the amount of the infrared radiation received by the detector into a voltage, and amplifiesn the voltage. Temperature detector 6 further converts the voltage into temperature data and outputs it to boiling detector 7. Detecting the boiling of the water in pan 1 based on this temperature data, boiling detector 7 outputs a signal indicative of the boiling of the water to heating controller 8. Receiving the signal, heating controller 8 instructs inverter 4 to reduce or stop the heating output to pan 1.

Temperature detector 6 detects the temperature (the amount of infrared radiation), and boiling detector 7 measures the difference between the temperature at a predetermined time and the temperature after a lapse of a predetermined period of time (e.g. 10 seconds) from the predetermined time every second. In other words, boiling detector 7 measures a gradient of the temperature rise. Boiling detector 7 determines that the water in pan 1 boils when detecting plural times that the temperature difference is within a predetermined range (e.g. ±1° C.), that is, the gradient of the temperature rise is within the predetermined range. The gradient of the temperature rise can be measured not only by this method. For example, a time required to provides a predetermined temperature rise may be measured. As described below, the temperature measurement with infrared detector 5 features that a temperature change of pan 1 can be measured quickly by detecting the change of the infrared radiation, but that it is difficult to measure an absolute temperature of pan 1.

Figure 2:
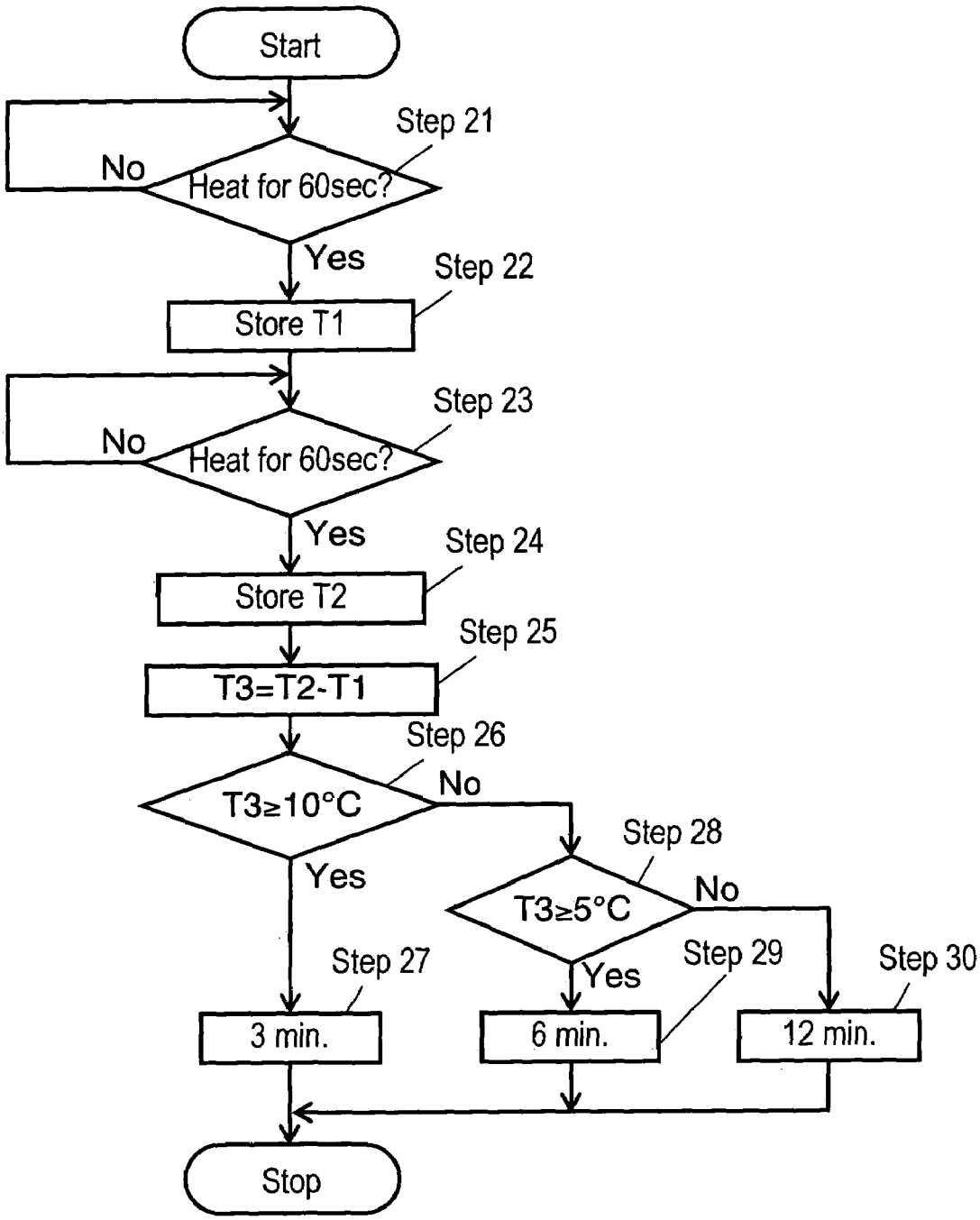
FIG. 2 is a flowchart illustrating an operation of the induction heating cooker according to Embodiment 1.

An operation of boiling detector 11 will be described with referring to FIG. 2. In this operation, boiling detector 11 detects the boiling of the water in pan 1 based on temperature information detected from the heat received by thermistor 9. FIG. 2 is a flowchart illustrating the operation of the induction heating cooker of Embodiment 1. When the water boiling instruction is input through switch 12*b*, heating coil 3 heats pan 1 for 60 seconds at a predetermined heating output (Step 21). Then, boiling detector 11 stores temperature T1 of bottom surface 2A of top plate 2 detected by thermistor 9 and temperature detector 10 (Step 22). Heating coil 3 heats pan 1 for another 60 seconds with the predetermined heating output (Step 23), that is, heats pan 1 for 120 seconds in total with the predetermined heating outputs. Then, boiling detector 11 stores temperature T2 of bottom surface 2A of top plate 2 detected by temperature detector 10 (Step 24). Boiling detector 11 calculates difference T3 between temperature T1 and temperature T2 (Step 25). Boiling detector 11 allows pan 1 to be heated with a predetermined heating output for a specific period of time, and then stops the heating (Steps 26 to 30). More specifically, when difference T3 is not lower than 10° C., boiling detector 11 instructs heating coil 3 to heat pan 1 for 3 minutes, and then, stops the heating. When difference T3 is not lower than 5° C. and is lower than 10° C., boiling detector 11 instructs heating coil 3 to heat pan 1 for 6 minutes, and then, stops the heating. When difference T3 is lower than 5° C., boiling detector 11 instructs heating coil 3 to heat pan 1 for 12 minutes, and then, stops the heating.

Thermistor 9, the thermo-sensitive element can measure the absolute temperature of bottom surface 2A of top plate 2 precisely while the temperature of pan 1 is stable. However, thermistor 9 has a slow transient response to the change of the temperature of pan 1 since measuring the temperature by the heat conduction from the bottom surface of pan 1. As described above, boiling detector 11 determines that the water in pan 1 boils by estimating a remaining time before the boiling based on the temperature rise (the gradient of temperature changes) measured at the time when the predetermined period of time has elapsed from the starting of the heating with a predetermined output (when a predetermined heating output power has been supplied to pan 1). In other words, boiling detector 11 estimates the amount of water in the pan 1 from the temperature rise, thereby estimating the remaining time before boiling based on the heating output and the estimated amount of water.

Heating controller 8 instructs inverter 4 to reduce or stop its output for inductionally-heating pan 1 with heating coil 3 when either boiling detector 7 or boiling detector 11 detects the boiling of the water in pan 1. Furthermore, heating controller 8 stops the operation of the boiling detector that has not detected the boiling so as to prevent the boiling detector from interfering the other boiling detector that has detected the boiling and from accordingly causing an unstable operation.

The timing to reduce or stop the induction heating output is not necessarily immediately after the detection of the boiling. The timing may be controlled according to the result of the detection of the boiling, for example, by delaying the timing by a predetermined time. The timing to stop the operation of the boiling detector that has not detected the boiling may be controlled in accordance with the detection result of the detector that has detected boiling.

Infrared radiation from the sun or an emitter (such as a oven toaster including a halogen lamp) located near top plate 2 may enter into top plate 2 through top surface 2B of top plate 2 near the bottom of pan 1, then propagates to its inside, and passes through bottom surface 2A to reach infrared detector 5 as ambient light. In this case, temperature detector 6 cannot properly detect temperatures. For example, the aforementioned condition to determine that the water in pan 1 boils may not be satisfied even if the water boils. If boiling detector 7 cannot detect the boiling, boiling detector 11 detects it instead.

The bottom surface of pan 1 is often concave at its center against top surface 2B of top plate 2 so that only the peripheral area of the bottom surface contacts top plate 2. Infrared detector 5 is located under heating coil 3 in its center. Thermistor 9 is located at the upper part of heating coil 3, and is closer to the periphery of heating coil 3 than infrared detector element 5. This arrangement increases the amount of heat received by thermistor 9 if the bottom of pan 1 is concave downwardly, that is, against top surface 2B of top plate 2. While pan 1 is placed on top plate 2, the center of the bottom of pan 1 is far from top surface 2B of top plate 2. The shorter the distance from the peripheral area is, the closer the bottom of pan 1 becomes to top surface 2B of top plate 2. Therefore, the distance between thermistor 9 and the bottom of pan 1 becomes shorter in the case that thermistor 9 is located closer to the periphery of heating coil 3 than the case that thermistor 9 is located at the center of heating coil 3, thereby facilitating the heat of the bottom of pan 1 to transmitted to thermistor 9. The heating of pan 1 with induction-heating coil 3 provides a temperature distribution in which the temperature becomes high in the area a little outside the center of heating coil 3. This indicates that thermistor 9 can be located closer to the periphery of heating coil 3 than infrared detector 5 as to receive a large amount of the heat from pan 1, thereby provides a high sensitivity to detect the temperature of pan 1. Infrared detector 5, which measures the infrared radiation passing through top plate 2 without contacting top plate 2, is not influenced by the concave bottom of pan 1 even if detector 5 is located at the center of heating coil 3.

Thus, during an ordinary operation, infrared detector 5 accurately detects that the water in pan 1 boils so as to reduce unnecessary evaporation of the water, thereby reducing its power consumption. Even if infrared detector 5 is affected by ambient light, thermistor 9, the thermo-sensitive element, can detect the boil, thereby preventing unnecessary, unexpected heating of pan 1. When infrared detector 5 does not function well and when the bottom of pan 1 is concave, thermistor 9 can back up infrared detector 5 stably.

Exemplary Embodiment 2

Figure 3:
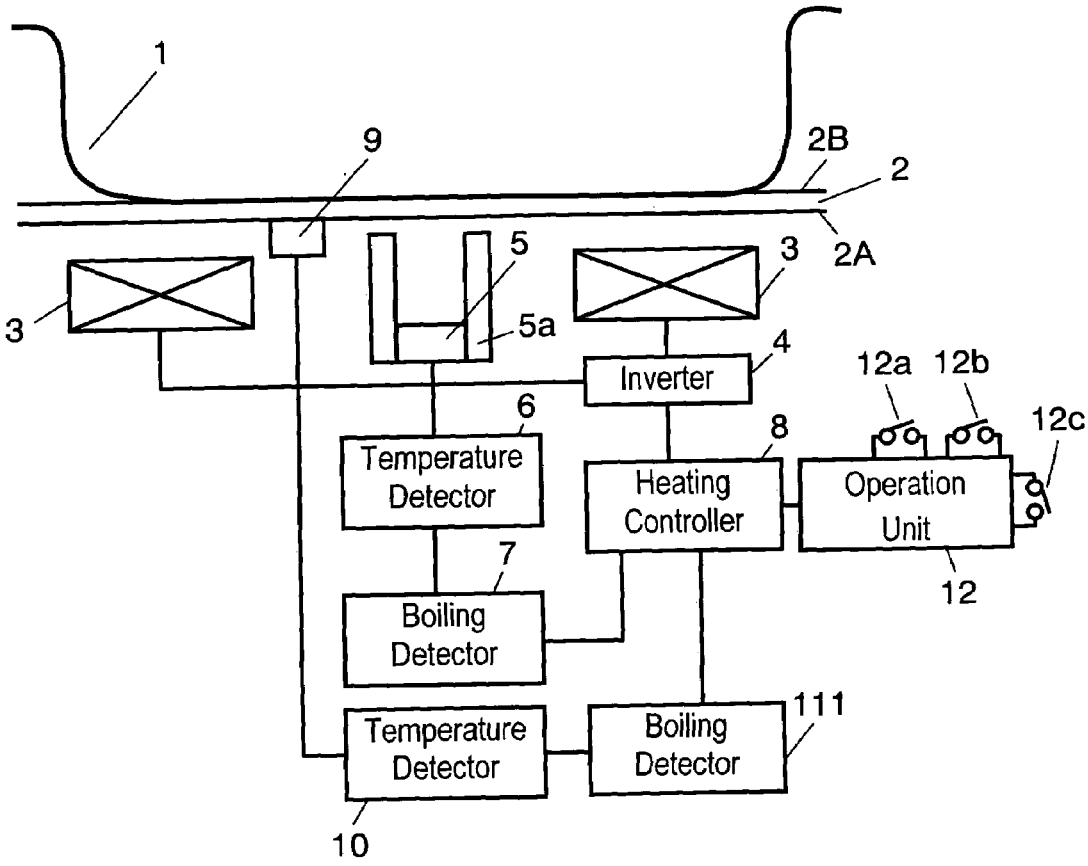
FIG. 3 is a block diagram of an induction heating cooker according to Exemplary Embodiment 2 of the invention.

FIG. 3 is a block diagram of an induction heating cooker according to exemplary Embodiment 2 of the present invention. The induction heating cooker of Embodiment 2 includes boiling detector 111 which operates differently from boiling detector 11 shown in FIGS. 1 and 2. Other components are identical to those of the induction heating cooker of Embodiment 1, and their description will be omitted.

Figure 4:
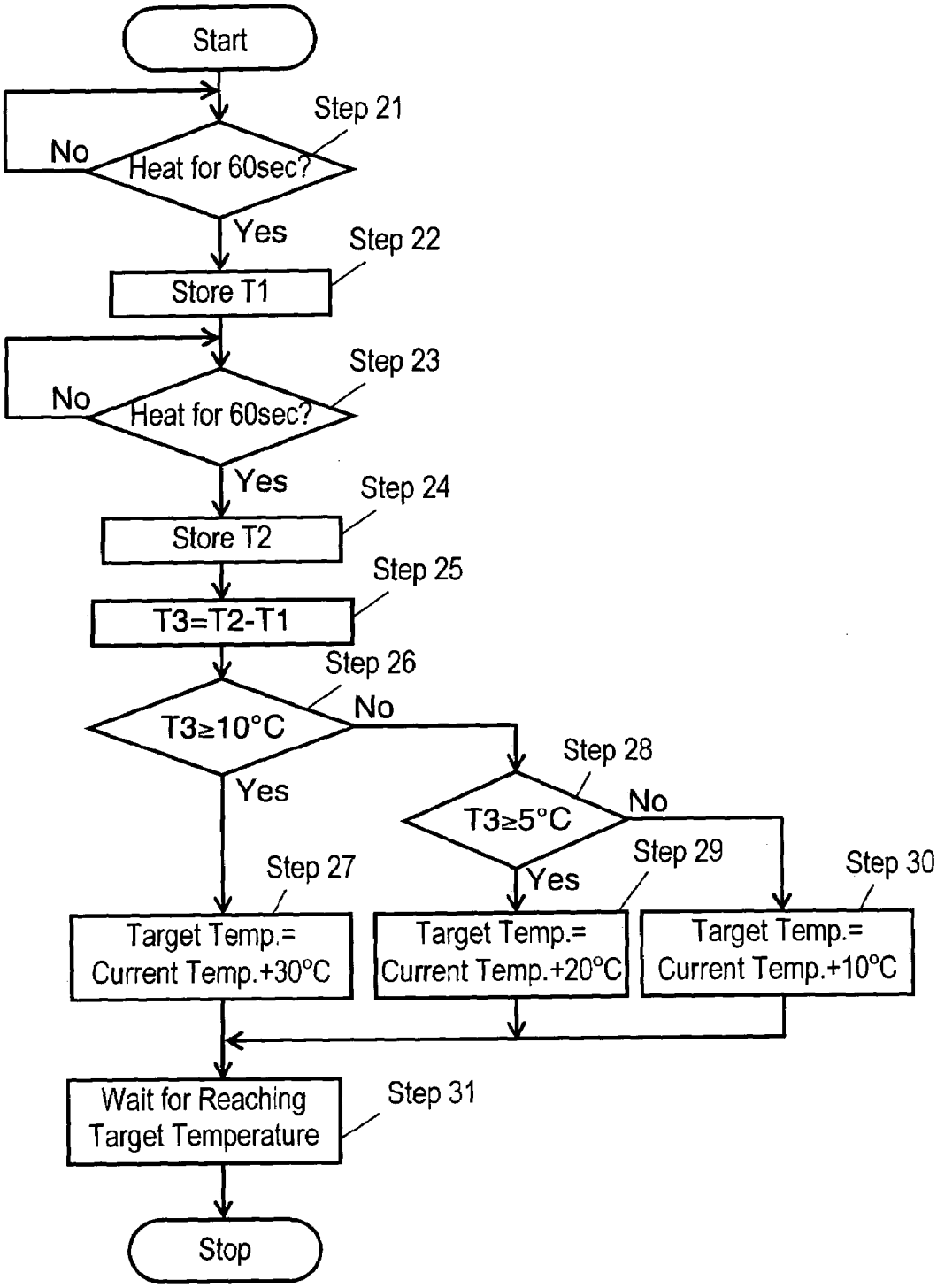
FIG. 4 is a flowchart illustrating an operation of the induction heating cooker according to Embodiment 2.

FIG. 4 is a flowchart illustrating an operation of the induction heating cooker of Embodiment 2. An operation of boiling detector 111 will be particularly described. When a water boiling instruction is input through switch 12*b*, heating coil 3 heats pan 1 for 60 seconds at a predetermined heating output (Step 21). Then, boiling detector 111 stores temperature T1 of bottom surface 2A of top plate 2 detected by temperature detector 10 (Step 22). Heating coil 3 heats pan 1 for another 60 seconds with the predetermined heating output (Step 23), that is, heats pan 1 for 120 seconds in total. Then, boiling detector 111 stores temperature T2 of bottom surface 2A of top plate 2 detected by temperature detector 10 (Step 24). Boiling detector 111 calculates difference T3 between temperature T1 and temperature T2 (Step 25). Then, based on difference T3, boiling detector 111 determines a target temperature to be detected by temperature detector 10 (Steps 26 to 30). When the temperature detected by temperature detector 10 reaches the target temperature (Step 31), boiling detector 111 determines that the water in pan 1 boils and stops the heating. If difference T3 is not lower than 10° C., boiling detector 111 sets the target temperature higher than the current temperature T2 of bottom surface 2A of top plate 2 by 30° C., and stops the heating of pan 1 when the temperature measured by temperature detector 10 reaches the target temperature. If difference T3 is not lower than 5° C. and lower than 10° C., boiling detector 111 sets the target temperature higher than temperature T2 by 20° C., and stops the heating of pan 1 when the temperature measured by temperature detector 10 reaches the target temperature. If difference T3 is lower than 5° C., boiling detector 111 sets the target temperature higher than temperature T2 by 10° C., and stops the heating of pan 1 when the temperature measured by temperature detector 10 reaches the target temperature.

As described in above, boiling detector 111 sets the target temperature in accordance with a temperature rise (a gradient of a temperature change) measured when a predetermined period of time has elapsed since the heating starts with the predetermined heating output (when a predetermined heating power has been supplied to pan 1). Then, boiling detector 111 determines that the water boils when the temperature detected by temperature detector 10 reaches the target temperature. In other words, boiling detector 111 estimates the amount of the water in pan 1 based on the temperature rise, and estimates the target temperature at which the water can be considered to boil based on the heating output and the amount of the water. Thus, when boiling detector 7 cannot detect the boiling due to ambient light, boiling detector 111 can detect the boiling instead. This feature enables the induction heating cooker of Embodiment 2 to reduce the amount of evaporation of the water, thereby reducing a power consumption.

Exemplary Embodiment 3

Figure 5:
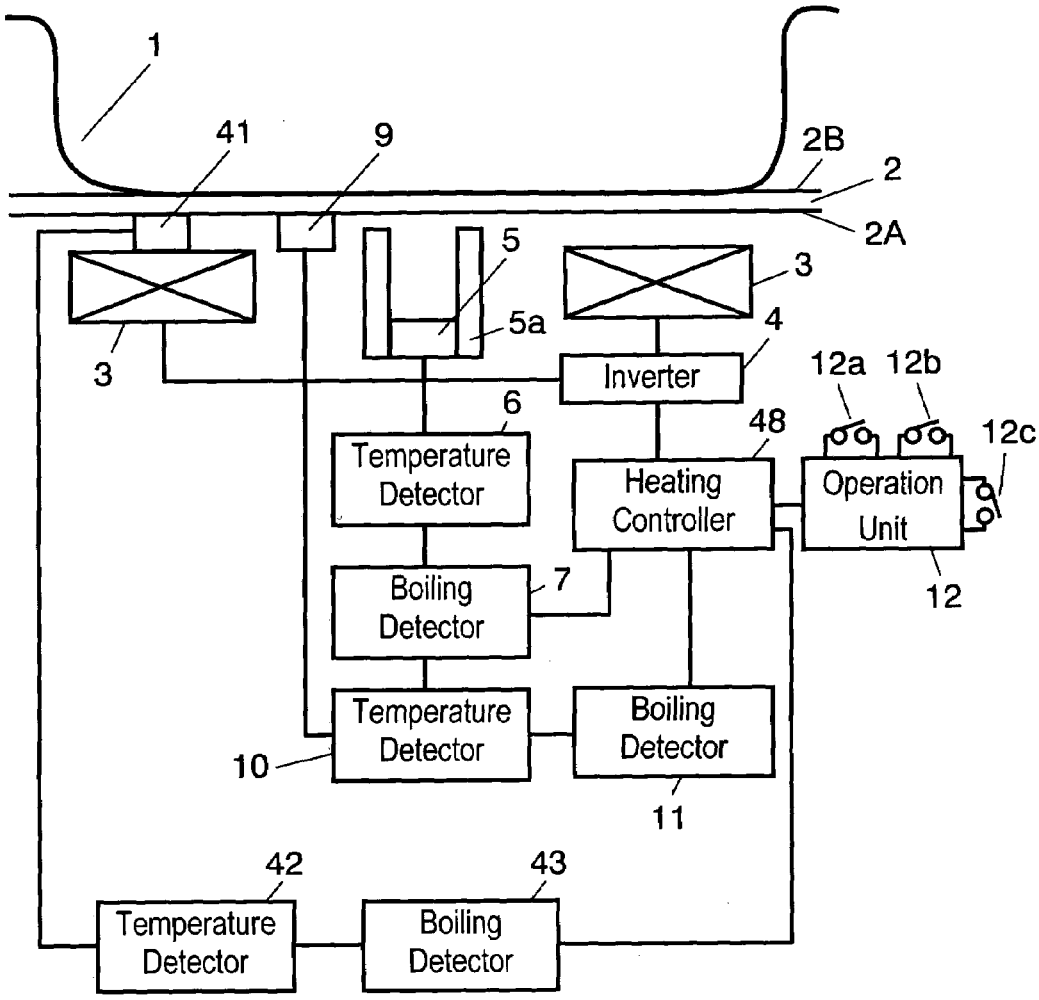
FIG. 5 is a block diagram illustrating an induction heating cooker according to Exemplary Embodiment 2 of the invention.

FIG. 5 is a block diagram of an induction heating cooker according to exemplary Embodiment 3 of the present invention. Only differences from the induction heating cooker of Embodiment 1 shown in FIG. 1 will be described.

Thermistor 41, as a thermo-sensitive element contacts bottom surface 2A of top plate 2 so as to receive the heat from bottom surface 2A at the upper part of heating coil 3 by heat conduction. Temperature detector 42 measures the temperature of bottom surface 2A and converts the temperature into temperature data. Thermistor 41 is located above heating coil 3 and closer to the periphery of heating coil 3 than thermistor 9. In other words, thermistor 41 is located at a position exposing to a more magnetic field generated by heating coil 3 than thermistor 9. Boiling detector 43 detects the boiling of water in pan 1 according to the sequence shown in FIG. 2 or 4 based on the temperature data output from temperature detector 42.

When either boiling detector 7, 11, or 43 detects the boiling of the water in pan 1, heating controller 48 stops an operation of inverter 4 or reduces its output power, and stops operations of the other boiling detectors.

Pan 1 has a bottom surface which is concave at its center against top surface 2B of top plate 2 so that only the peripheral area of the bottom surface contacts top plate 2. Thermistor 41 is located near the center of a wire-winding portion of heating coil 3, or above the peripheral area of heating coil 3 exposing to a more magnetic field generated by heating coil 3 than thermistor 9. Therefore, in the case that pan 1 having the concave bottom is inductionally-heated, thermistor 41 is located at a position where the distance between the bottom surface of pan 1 and top plate 2 is smaller, and where it gets hotter than the remaining area of the bottom of pan 1. Thermistor 41 thus allows temperature detector 43 to detect the temperature of pan 1 sensitively.

As described in above, when infrared detector element 5 cannot detect the boiling of the water in pan 1 due to ambient light, and when thermistor 9 cannot detect the boiling either due to the concave bottom of pan 1, thermistor 41 can detect the boiling instead. This arrangement makes the induction heating cooker of Embodiment 3 safer.

Exemplary Embodiment 4

Figure 6:
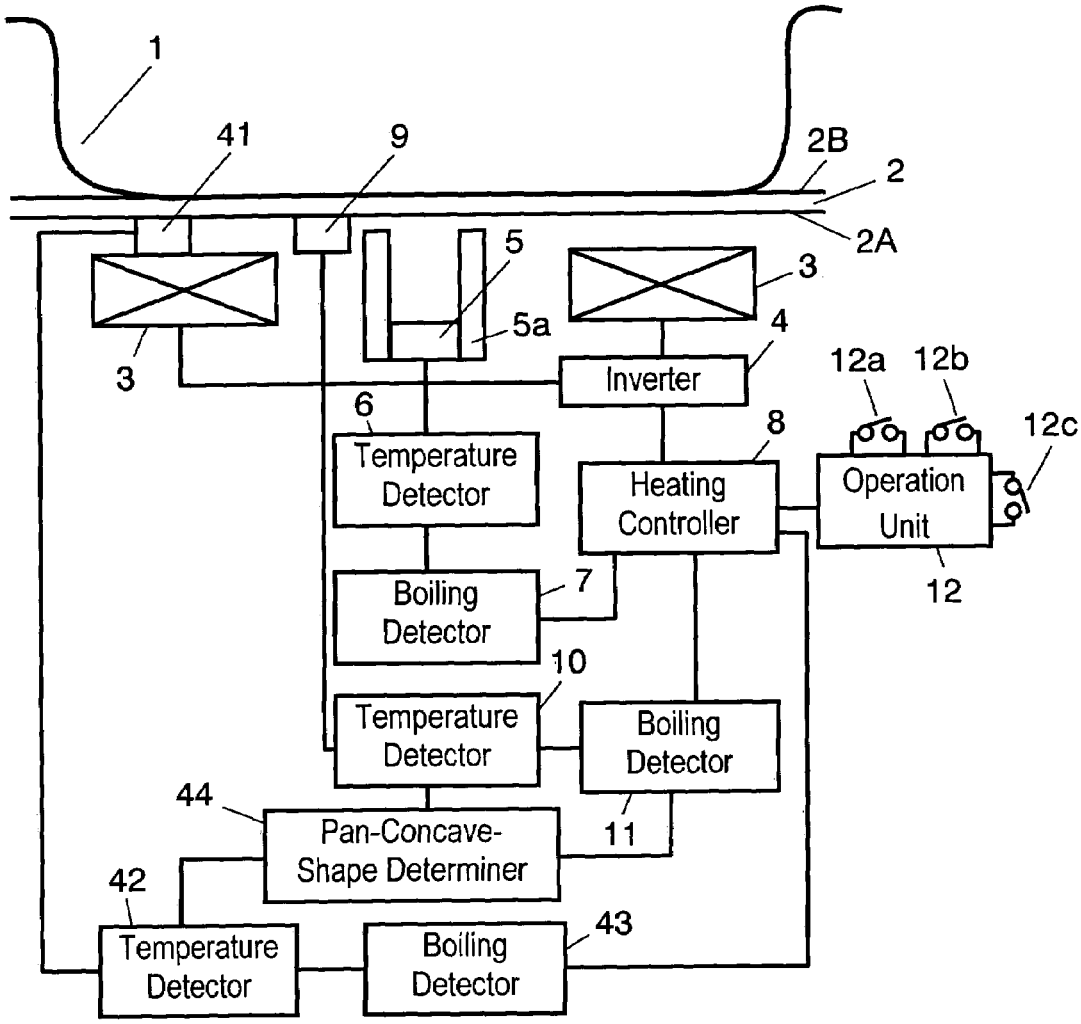
FIG. 6 is a block diagram of an induction heating cooker according to Exemplary Embodiment 4 of the invention.

FIG. 6 is a block diagram of an induction heating cooker according to exemplary Embodiment 4 of the present invention. Only differences from the induction heating cooker of Embodiment 1 shown in FIG. 1 will be described.

Pan-concave-shape determiner 44 determines the degree of the concave shape of a bottom of pan 1 by plural of levels (e.g., three levels) of classification based on the temperature difference between a temperature detected by temperature detector 10 and a temperature detected by temperature detector 42, and corrects a duration for heating pan 1 under control of boiling detector 11. If the temperature difference is large, pan-concave-shape determiner 44 determines that the bottom of pan 1 has a largely-concave shape, and reduces the duration to heat pan 1 at Steps 27, and 29, and 30 shown in FIG. 2.

This operation enables boiling detector 11 to detect the boiling of the water in pan 1 accurately regardless of the concave shape of the bottom of pan 1.

Exemplary Embodiment 5

Figure 7:
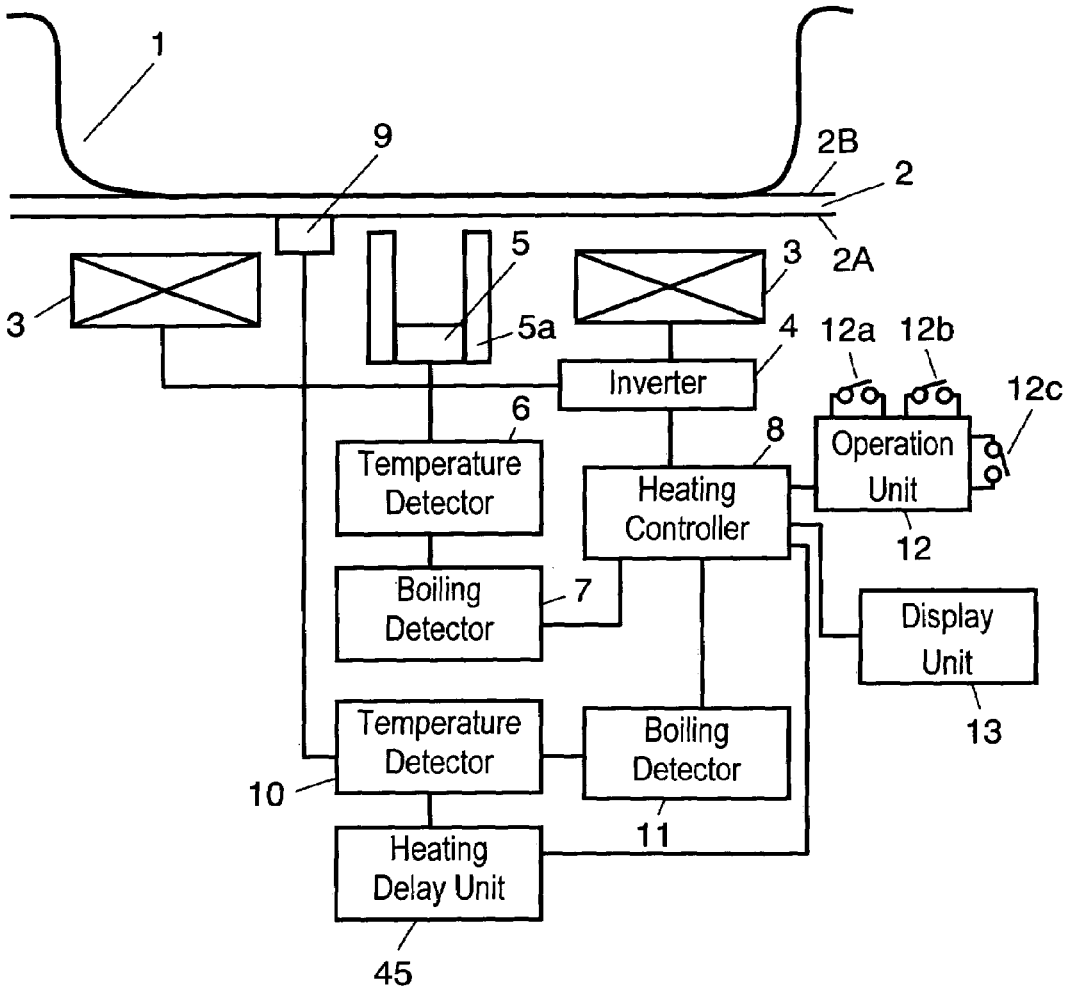
FIG. 7 is a block diagram of an induction heating cooker according to exemplary Embodiment 5 of the invention.

FIG. 7 is a block diagram of an induction heating cooker according to exemplary Embodiment 5 of the present invention. Only differences from the induction heating cooker of Embodiment 1 shown in FIG. 1 will be described.

If temperature detector 10 detects that a temperature of bottom surface 2A of top plate 2 is high but comparatively low, e.g. is not lower than a first temperature (e.g. 80° C.) and not higher than a second temperature (e.g. 100° C.), and that temperature detector 10 detect the boiling after a period of time which the user can wait for, heating delay unit 45 inhibits heating controller 8 from executing the "water boiling instruction" input through switch 12*b* until the temperature detected by temperature detector 10 drops to a predetermined temperature (e.g. 60° C.). When the temperature drops to the predetermined temperature, heating delay unit 45 enables heating controller 8 to inductionally-heat pan 1. In this case, while waiting, the user is not informed of the starting of the heating. Thus, the induction heating cooker can properly measure a temperature change corresponding to a heating power supplied to pan 1 so as to property detect the boiling. Furthermore, the induction heating cooker does not provide the user with misleading information, thereby being used easily.

When temperature detector 10 detects that the temperature of top plat 2 is a pretty high third temperature (e.g. 120° C.) higher than the second temperature, it is expected that the boiling cannot be detected after a long time of waiting. In this case, heating delay unit 45 inhibits the heating controller from executing the "water boiling instruction" input through switch 12*b* so as to prevent the start of induction heating of pan 1. In addition, display unit 13 informs the user visually or vocally that the "water boiling instruction" is not executable. The user can be thus informed that he/she is required to wait. This can provide the induction heating cooker with safety and usability.

Exemplary Embodiment 6

Figure 8:
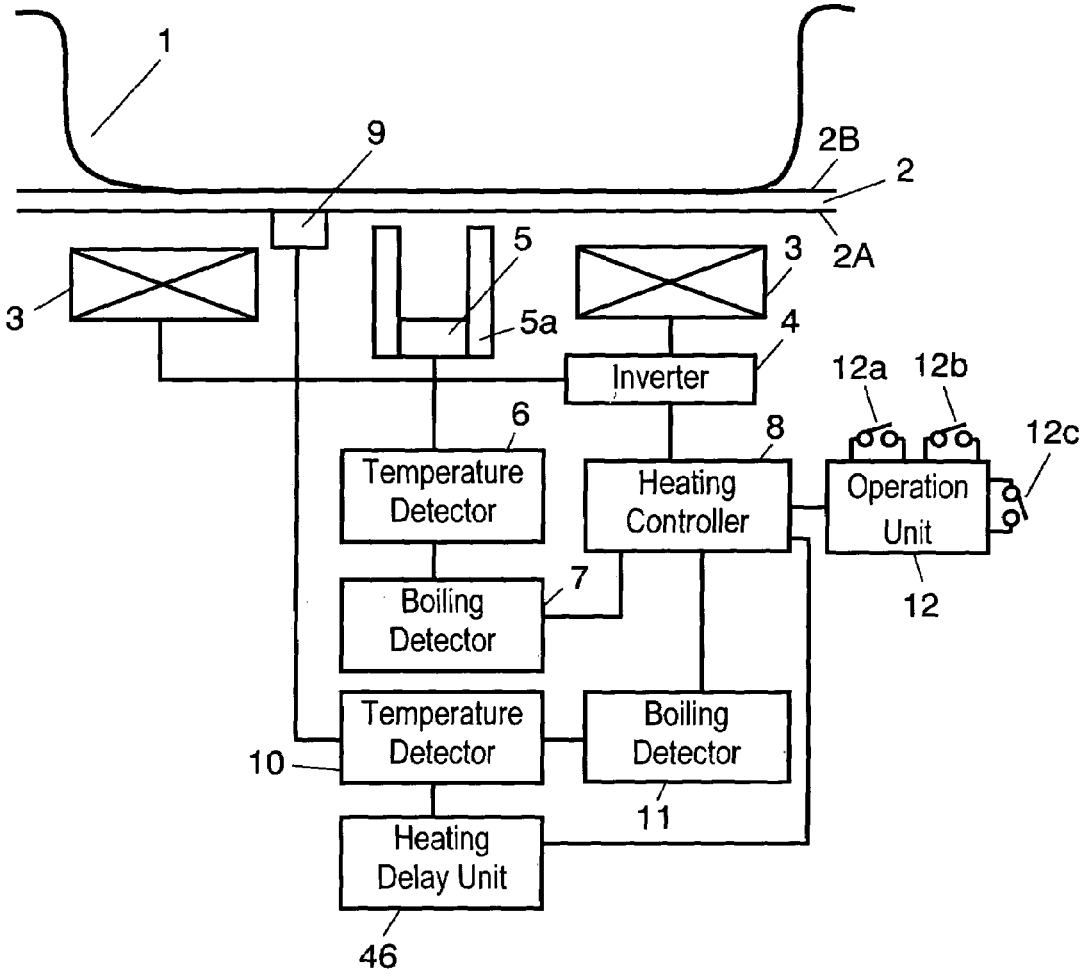
FIG. 8 is a block diagram of an induction heating cooker according to Exemplary Embodiment 6 of the invention.

FIG. 8 is a block diagram of an induction heating cooker according to Exemplary Embodiment 6 of the present invention. Only differences from the induction heating cooker of Embodiment 1 shown in FIG. 1 will be described.

When temperature detector 10 detects that the temperature of bottom surface 2A of top plate 2 is high (e.g. not lower than 80° C.), heating delay unit 46 outputs a signal indicating that a temperature of top plate 2 is high. When heating delay unit 46 outputs the signal, heating controller 8 suspends induction heating for a predetermined period of time (e.g. 60 seconds) even when the "water boiling instruction" is input through switch 12B, and later executes the "water boiling instruction". A temperature detected by temperature detectors 6 and 10 during the suspending provides information regarding water in pan 1. The sequence for the detecting of the boiling can be corrected based on the information so as to detect the boiling of the water.

Thus, when top plate 2 is still hot even after cooking, the induction heating cooker of Embodiment 6 can detect the boiling after a predetermined period of time has elapsed, thus providing more usability.

Exemplary Embodiment 7

Figure 9:
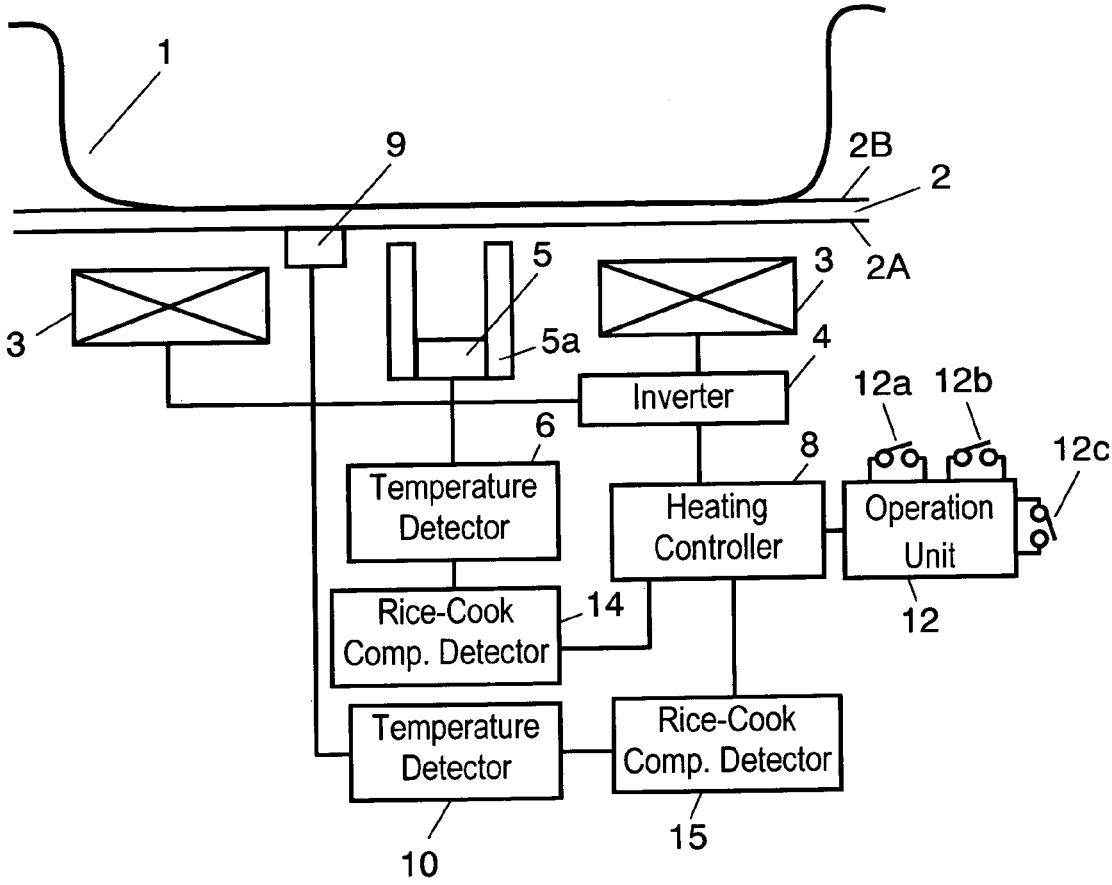
FIG. 9 is a block diagram of an induction heating cooker according to Exemplary Embodiment 7 of the invention.

FIG. 9 is a block diagram of an induction heating cooker according to Exemplary Embodiment 7 of the present invention. This induction heating cooker can cook rice and water put in pan 1. In the heating cooker of Embodiment 7, boiling detector 7 and boiling detector 11 of the induction heating cooker of Embodiment 1 shown in FIG. 1 are replaced by rice-cooking-completion detector 14 and rice-cooking-completion detector 15, respectively.

Switch 12*c* is an automatic rice-cooking key to input a "rice-cooking instruction" to start an automatic rice-cooking sequence. In this sequence, rice is cooked with water in pan 1, a user is informed of the completion of rice cooking upon the completion being detected, and a heat-retaining operation (an output is decreased to a predetermined level) starts.

In the rice-cooking operation, the rice-cooking instruction starts, a first sequence is executed based on values measured by infrared detector 5 and rice-cooking completion detector 14, and a second sequence is executed based on values measured by thermistor 9 and rice-cooking completion detector 15.

In an ordinary operation, the first sequence is executed substantially. In the first sequence, temperature detector 6 detects that a temperature change of pan 1 from the start of the rice-cooking operation reaches a predetermined value, and measures the temperature of pan 1 when the time required for the water to boil has elapsed, thereby detecting that the temperature reaches temperature T4 (e.g. 100° C.). After that, when no water is left and when the temperature rises up to temperature T5 (e.g. 130° C.), rice-cooking completion detector 14 determines that the rice cooking is completed.

In the second sequence, when temperature detector 10 detects that the temperature of pan 1 exceeds predetermined temperature T6 (e.g. 130° C.), rice-cooking completion detector 15 estimates that the water boils out and that the temperature is increasing, and determines that the rice cooking is completed. When the boiling of the water is detected in either of these sequences or when an reduction is reduced after that, the other sequence stops. This operation prevents these sequences from interfering each other and prevents the induction heating cooker from being used hard.

Thus, during the ordinary operation, infrared detector 5 detects accurately that the water boils and evaporates out during the rice cooking. This allows the induction heating cooker of Embodiment 7 to detect the completion of rice cooking, thereby enabling the cooker to be used easily. Furthermore, even when infrared detector 5 cannot determine whether the temperature of pan 1 becomes stable due to ambient light, thermistor 9 can detect the completion of the rice cooking, thereby preventing unnecessary heating from continuing.

According to Embodiment 7, the first and second sequences in which heating controller 8 controls a power output from of inverter 4 based on the temperature measured by temperature detector 6 and the temperature measured by temperature detector 10 are described as the sequences to be executed by rice-cooking completion detectors 14 and 15. However, besides these operations, these sequences can be applied to a sequence in which the heating controller controls the output of the inverter based on the temperature of pan 1 detected by infrared detector 5 and thermistor 9, a thermo-sensitive element.

According to Embodiment 1 or 7, the condition that execution of one of the first sequence based on the value measured by infrared detector 5 and the second sequence based on the value measured by thermistor 9 stops execution of the other of the first and second sequences is not limited to that the completion of the one of the first and second sequences, and may be that partial completion of the one of the first and second sequences in the case, for example, that the one of the sequences can continue even if there is interference by ambient light, or that the interference by ambient light continues for a predetermined period of time.

INDUSTRIAL APPLICABILITY

A induction heating cooker can detect a temperature change of a load pan accurately by detecting the amount of infrared radiation generated from the load pan, and can detect the temperature of the load pan by heat conduction from the load pan regardless of ambient light, thereby preventing unintended heating from continuing.

The invention claimed is:

1. An induction heating cooker comprising:

a top plate having a first surface and a second surface, the first surface of the top plate being arranged to have a load pan placed over the first surface, the top plate being capable of transmitting infrared radiation;

a heating coil for inductionally-heating the load pan;

an inverter for supplying a high-frequency current to the heating coil;

an infrared detector for detecting infrared radiation emitted from the load pan, the infrared detector being located under the second surface of the top plate;

a first temperature detector for detecting a temperature of the load pan based on an output of the infrared detector;

a heating controller operable to determine that the temperature of the load pan becomes stable if a condition that a change of the temperature detected by the first temperature detector is within a predetermined range for a predetermined period of time is satisfied, and to control a power output from the inverter based on a determination result;

a first thermo-sensitive element for receiving heat from the top plate; and a second temperature detector for detecting a temperature of the load pan based on an output of the first thermo-sensitive element, wherein, when the temperature detected by the first temperature detector does not satisfy the condition, the heating controller determines that the temperature of the load pan becomes stable based on the temperature detected by the second temperature detector.

2. The induction heating cooker according to claim 1, wherein the infrared detector is located near a center of the heating coil, and wherein the first thermo-sensitive element is located closer to a periphery of the heating coil than the infrared detector.

3. The induction heating cooker according to claim 1, wherein the heating controller is operable to:

execute a first sequence in which the power output from the inverter is controlled by determining that the temperature of the load pan becomes stable based on a temperature detected by the first temperature detector, and execute a second sequence in which the power output from the inverter is controlled by determining that the temperature of the load pan becomes stable based on a temperature detected by the second temperature detector, execute the first sequence and the second sequence concurrently based on an execution instruction input, and when at least a part of one of the first sequence and the second sequence is complete, stop executing the other of the first sequence and the second sequence.

4. The induction heating cooker according to claim 3, further comprising:

a first boiling detector for executing the first sequence, wherein, in the first sequence, the power output from the inverter is reduced or stopped when detecting that the temperature of the load pan becomes stable; and a second boiling detector for executing the second sequence, wherein, in the second sequence, the power output from the inverter is reduced or stopped when detecting that the temperature of the load pan becomes stable, wherein, when the first boiling detector detects that the temperature of the load pan becomes stable, the heating controller instructs the second boiling detector to stop executing the second sequence.

5. The induction heating cooker according to claim 3, further comprising:

a first boiling detector for executing the first sequence, wherein, in the first sequence, the power output from the inverter is reduced or stopped when detecting that the temperature of the load pan becomes stable; and a second boiling detector for executing the second sequence, wherein, in the second sequence, the power output from the inverter is reduced or stopped when detecting that the temperature of the load pan becomes stable, wherein, when the second boiling detector detects that the temperature of the load pan becomes stable, the heating controller instructs the first boiling detector to stop executing the first sequence.

6. The induction heating cooker according to claim 1, further comprising:

a first detector for, after detecting that the temperature of the load pan is stabilized, executing a first sequence in which the power output from the inverter is reduced or stopped when detecting that the temperature of the load pan rises by a predetermined temperature from the stabilized temperature; and a second detector for, after detecting that the temperature of the load pan is stabilized, executing a second sequence in which the power output from the inverter when detecting that the temperature of the load pan rises by a predetermined temperature from the stabilized temperature, wherein the heating controller is operable to prevent the second detector from executing the second sequence when detecting the first detector completes the first sequence.

7. The induction heating cooker according to claim 6, further comprising a second thermo-sensitive element located closer to a periphery of the heating coil than the first thermo-sensitive element, the second thermo-sensitive element measuring a temperature of the second surface of the top plate, wherein the second detector executes the second sequence based on a temperature measured by the first thermo-sensitive element and the temperature measured by the second thermo-sensitive element.

8. The induction heating cooker according to claim 7, wherein the second thermo-sensitive element is located at a position exposing to a more magnetic field generated by the heating coil than the first thermo-sensitive element.

9. The induction heating cooker according to claim 6, further comprising a second thermo-sensitive element located at a position exposing to a more magnetic field generated by the heating coil than the first thermo-sensitive element, the second thermo-sensitive element measuring a temperature of the second surface of the top plate, wherein the second detector executes the second sequence based on a temperature measured by the first thermo-sensitive element and the temperature measured by the second thermo-sensitive element.

10. The induction heating cooker according to claim 1, further comprising:

a first detector for executing a first sequence in which, after detecting that the temperature of the load pan is stabilized, the power output from of the inverter is reduced or stopped when detecting that the temperature of the load pan rises by a predetermined temperature from the stabilized temperature; and, a second detector for executing a second sequence in which, after detecting that the temperature of the load pan is stabilized, the power output from the inverter is reduced or stopped when detecting that the temperature of the load pan rises by a predetermined temperature from the stabilized temperature, wherein the heating controller is operable to prevent the first detector from executing the first sequence when detecting the second detector completes the second sequence.

11. The induction heating cooker according to claim 10, further comprising a second thermo-sensitive element located closer to a periphery of the heating coil than the first thermo-sensitive element, the second thermo-sensitive element measuring a temperature of the second surface of the top plate, wherein the second detector executes the second sequence based on a temperature measured by the first thermo-sensitive element and the temperature measured by the second thermo-sensitive element.

12. The induction heating cooker according to claim 11, wherein the second thermo-sensitive element is located at a position exposing to a more magnetic field generated by the heating coil than the first thermo-sensitive element.

13. The induction heating cooker according to claim 10, further comprising a second thermo-sensitive element located at a position exposing to a more magnetic field generated by the heating coil than the first thermo-sensitive element, the second thermo-sensitive element measuring a temperature of the second surface of the top plate, wherein the second detector executes the second sequence based on a temperature measured by the first thermo-sensitive element and the temperature measured by the second thermo-sensitive element.

14. The induction heating cooker according to claim 1, wherein, after a predetermined power is supplied to the load pan, the second detector measures a change of a temperature of the second surface in a predetermined time, and determines that the temperature of the load becomes stable when the measured change of the temperature is within a predetermined range a predetermined period of time.

* * * * *